US005143369A

United States Patent [19]

Meisel et al.

[11] Patent Number: 5,143,369

[45] Date of Patent: Sep. 1, 1992

[54] APPARATUS FOR PARTING A SHINGLED FLOW OF FLAT PRODUCTS, PARTICULARLY OF AT LEAST TWO-LAYER PAPER PRODUCTS

[76] Inventors: Ronald Meisel, D-8113 Kochel/See, Am Lainbach 23; Michael Hast, Geranienstrasse 6A, D-8000 München 70, both of Fed. Rep. of Germany

[21] Appl. No.: 622,550

[22] Filed: Dec. 5, 1990

[30] Foreign Application Priority Data

Dec. 5, 1989 [DE] Fed. Rep. of Germany ..... 3940243

[51] Int. Cl.[5] ..... B65H 29/66

[52] U.S. Cl. ..... 271/303; 271/285

[58] Field of Search ..... 271/285, 286, 302, 303

[56] References Cited

U.S. PATENT DOCUMENTS

| | | | |
|---|---|---|---|
| 1,071,272 | 8/1913 | Spiess | 271/303 |
| 2,815,949 | 12/1957 | Faeber | 271/303 |
| 3,724,657 | 4/1973 | Katagiri et al. | 271/302 |
| 3,861,259 | 1/1975 | Hitch | 271/303 |
| 3,866,902 | 2/1975 | Feldkamper | 271/303 |
| 3,955,812 | 5/1976 | Sudad et al. | 271/286 |
| 4,151,986 | 5/1979 | Kawada | 271/303 |
| 4,283,048 | 8/1981 | Müller | 271/303 |
| 4,302,198 | 11/1981 | Kawada | 271/303 |
| 4,424,966 | 1/1984 | Chandhoke | 271/302 |
| 4,426,074 | 1/1984 | Fischer | 271/302 |
| 4,447,052 | 5/1984 | Müller | 271/303 |
| 4,810,153 | 3/1989 | Armelin | 271/302 |
| 4,953,843 | 9/1990 | Reist | 271/303 |

FOREIGN PATENT DOCUMENTS

| | | | |
|---|---|---|---|
| 2330614 | 1/1975 | Fed. Rep. of Germany | 271/303 |
| 2820877 | 12/1978 | Fed. Rep. of Germany | 271/302 |
| 64-965 | 3/1989 | Japan | 271/280 |
| 1010733 | 11/1965 | United Kingdom | 271/303 |

*Primary Examiner*—Robert P. Olszewski
*Assistant Examiner*—Steven M. Reiss
*Attorney, Agent, or Firm*—Palmatier & Sjoquist

[57] ABSTRACT

An apparatus for parting a shingled flow of two-layer paper products in the vertical direction with a rotatable deflector sheave and a wedged-shape deflector, both pivotally mounted above the shingled flow, wherein the wedged-shaped deflector may be inserted into the shingled flow and retracted at a speed in the conveying direction which exceeds the conveying speed of the shingled flow.

2 Claims, 4 Drawing Sheets

APPARATUS FOR PARTING A SHINGLED FLOW OF FLAT PRODUCTS, PARTICULARLY OF AT LEAST TWO-LAYER PAPER PRODUCTS

The invention relates to an apparatus for parting a shingled flow of flat products, particularly of at least two-layer paper products in the vertical direction.

An apparatus of this kind is disclosed by DE-OS 33 01 852; however, in this apparatus two shingled flows offset from each other are fed to a parting apparatus, each shingled flow component being gripped by clips at the side and parted in this clipped condition, after which the clips are released from the shingled flow. This known apparatus can only be used when the feed or conveyed shingle flow comprises two side sections offset from each other, otherwise it is not possible for the clips to grip. A single shingled flow having e.g. a usual conveying speed of 40,000 paper products per hour cannot be parted by this known apparatus.

The present invention is based on the problem of permitting parting the flow of shingled flat products, particularly paper products, even when the shingled flow is conveyed in the usual way and even involving differing shingle spacings.

This problem is solved by the invention providing a wedge-shaped parting means which is inserted into the shingled flow and can be retracted at a speed in the conveying direction which exceeds the conveying speed of the shingled flow.

In this way, newspapers—for instance—being conveyed shingled can be split, stacked and cross-laid in two shingled components after a corresponding count. This apparatus also complies with the fact that this work is usually done at a conveying speed of 40,000 pieces per hour. In this case, shingled components of e.g. 20 and more paper products can be parted and directed to separate stacking.

According to a preferred embodiment of the invention the parting means can be swivelled by a bracket or the like to a point of rotation located above the shingled flow. Instead of a bracket an L-shaped holder can be provided.

To facilitate parting by the wedge-shaped parting means the shingled flow can feature a cascaded step at the level of the parting means being introduced into the flow.

It is also possible that for discharging the parted component of the shingled flow that a pair of press belts is provided, the one belt working together with the other. Each press belt can comprise a single belt or a plurality of narrow belts spaced alongside each other and extending over the full width of the product flow.

According to a particularly preferred embodiment of the invention the pair of press belts is made up of two endless belts each guided separately. It is good practice when the parting means and a deflector sheave for the press belt pair form a single unit; the bracket carrying the parting means can also hold the deflector sheave and can be swivelled about a common point of rotation. This arrangement enables, on the one hand, the parting means to be separated from the conveyed shingled flow and, on the other hand, the two press belts to be "elongated" by a certain amount so that the relative circumferential velocity of the deflector sheave is increased, but nevertheless ensuring that the discharge speed of the parted shingled flow component is the same as that of the conveyed shingled flow. To achieve this "elongation" of the press belt pair, each of the endless belts can feature a takeup pulley or roller, these takeup pulleys being best provided on guiding members or the like.

Naturally the deflector sheave is directly followed by a discharge conveyor however, by consequence this means that discharge is in the opposite direction to that of the shingled flow. If discharge of the parted shingled flow component is required in the same direction of that of the shingled flow, the deflector sheave can be followed by an overhead conveyor; the discharge conveyor following the overhead conveyor for handling the parted shingled flow component then best being located above the discharge conveyor of the component of the shingled flow which is passed on.

According to a modified embodiment of the invention the parting means is followed by a deflector sheave having a press belt. In this case the parted component of the shingled flow is held clamped and correspondingly conveyed between the press belt and the surface of the deflector sheave.

If the parted shingle flow component is required to be discharged in the opposite direction to that of the feeding conveyor, the deflector sheave can be followed by e.g. a suitable endless discharging conveyor Should, however, the parted shingled flow component need to be further transported in the feed direction of the shingled flow, the deflector sheave can be followed by an overhead conveyor. Another possibility is to include between the deflector sheave and the overhead conveyor an endless rider belt and to cause the overhead conveyor to feature a pair of press belts. It is then good practice to cause the rider belt and the pair of press belts to rotate about a common axis when the parting means is active; another possibility is arrange for the spacing of the two outer deflector sheaves of the rider belt to be adjustable.

The drawing depicts the embodiments of the invention simplified, their details being described in the following, whereby:

A shingled flow 2 of newspapers 1 is fed by an endless conveyor to a parting means, described in more detail in the following, at a speed of e.g. 40,000 newspapers per hour. In synchronism with the endless conveyor a discharge conveyor 4 for one component of the shingled flow and also a discharge conveyor 5 for a parted shingled flow component can be powered.

Figure 1:
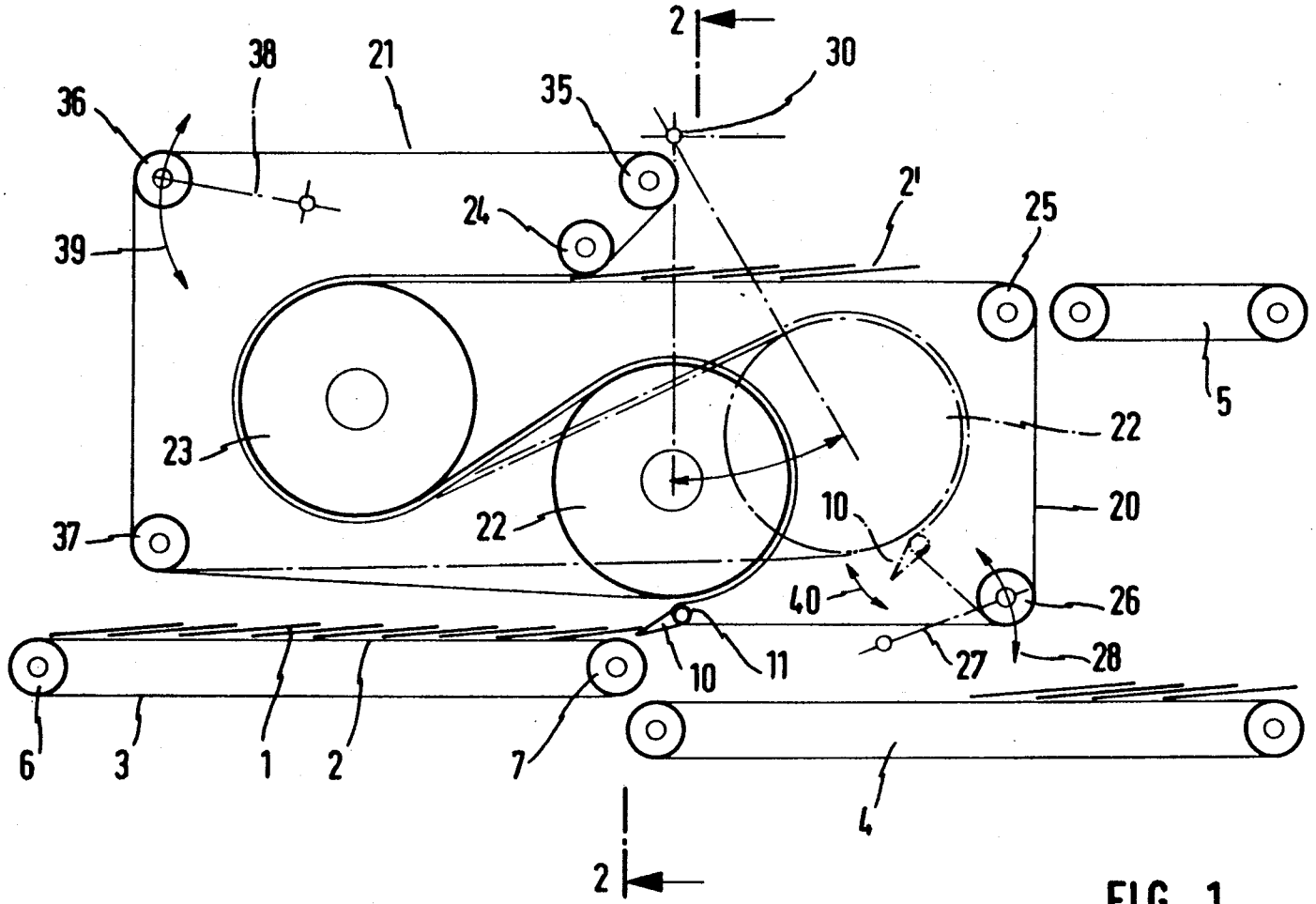
FIG. 1 is a side view of one embodiment.

The endless conveyor 3 features two deflector sheaves 6 and 7, the latter being offset cascaded and following the discharge conveyor 4 for non-parted shingled flow. A wedge-shaped parting means 10 is secured to a shaft 11 which with its two holders 12 and 13—as can be seen from FIG. 2—forms a bow or bracket. The wedge-shaped parting means is introduced by suitable control means between two shingles ( as shown in FIG. 1) so that from this moment on, the shingled flow is conveyed via the upper portion of the means as shown in FIG. 1. To discharge the parted component of the shingled flow a pair of press belts is provided which comprises a lower press belt 20 and an upper press belt 21. Folded paper products e.g. newspapers are caught between these two press belts and guided around a deflector sheave or roller 22 thru an angle of more than 180°, before being fed—according to the embodiment shown—to a further deflector sheave or an overhead conveyor 23. Following a small deflector sheave 24 the two belts are separated from each other, so that the parted shingle flow component 2' is further transported on the lower belt only for feeding to the discharge conveyor 5 which is located above the discharge conveyor 4.

The lower belt 20 is guided free to turn via the center part of the parting means 10 in the embodiment shown and is then wrapped around the deflector sheave 22 by approx. 200°. After this the belt leads to the overhead conveyor 23 and to a deflector sheave 25. A takeup pulley (or roller) 26 is fitted to a guiding member 27 and—as indicated by the arrow 28—is free to swivel. The two holders 12 and 13 are also free to swivel about an axis 30; the corresponding shaft 31 is held in the bearings 32 and 33. The holders 12,13 also carry the shaft 34 and the deflector sheave 22.

The wedge-shaped parting means 10 located free to swivel features in the region of the deflector sheave 22 a round cross-section so that the lower press belt 20 is suitably held. To the side of the middle region the wedge-shaped abutments are provided to form the parting means. These abutments are firmly connected to the shaft 11 and thus located free to turn with the latter.

The upper belt 21 is wrapped around the deflector sheave 22 by roughly 210 degrees of an arc and leads to the overhead conveyor 23 and then to the deflector sheaves 24, 35, to the takeup pulley ( or roller) 36 before finally connecting the deflector sheave 37. The takeup pulley (or roller)36 is fitted to a guiding member 38 and free to swivel in the direction of the arrow 39.

To terminate separation of the shingled component by the parting means.(10),.the latter must be removed from the shingled flow 2. The speed with which this happens must always be higher than the speed with which the shingled flow is conveyed.

To achieve this, the two holders 12 and 13 are swivelled away together with the deflector sheave 22 and the parting means 10—as indicated by the dashed lines in FIG. 1. This swivelling-away action results in "elongation" of the two press belts in the area between the deflector sheave 22 and the overhead conveyor 23. To permit this "elongation" the takeup pulleys ( or rollers) 26 and 36 are provided which, where necessary, are located spring-mounted.

Swivelling the deflector sheave 22 results in the belt sections of the two press belts between the deflector sheaves 22 and 23 becoming larger, the same applying to the belt section of the outer belt between the deflector sheaves 22 and 37, this being made possible by the movement of the takeup pulleys (rollers) 26 and 36. During swivelling the circumferential velocity of the deflector sheave 22 is increased.

Figure 2:
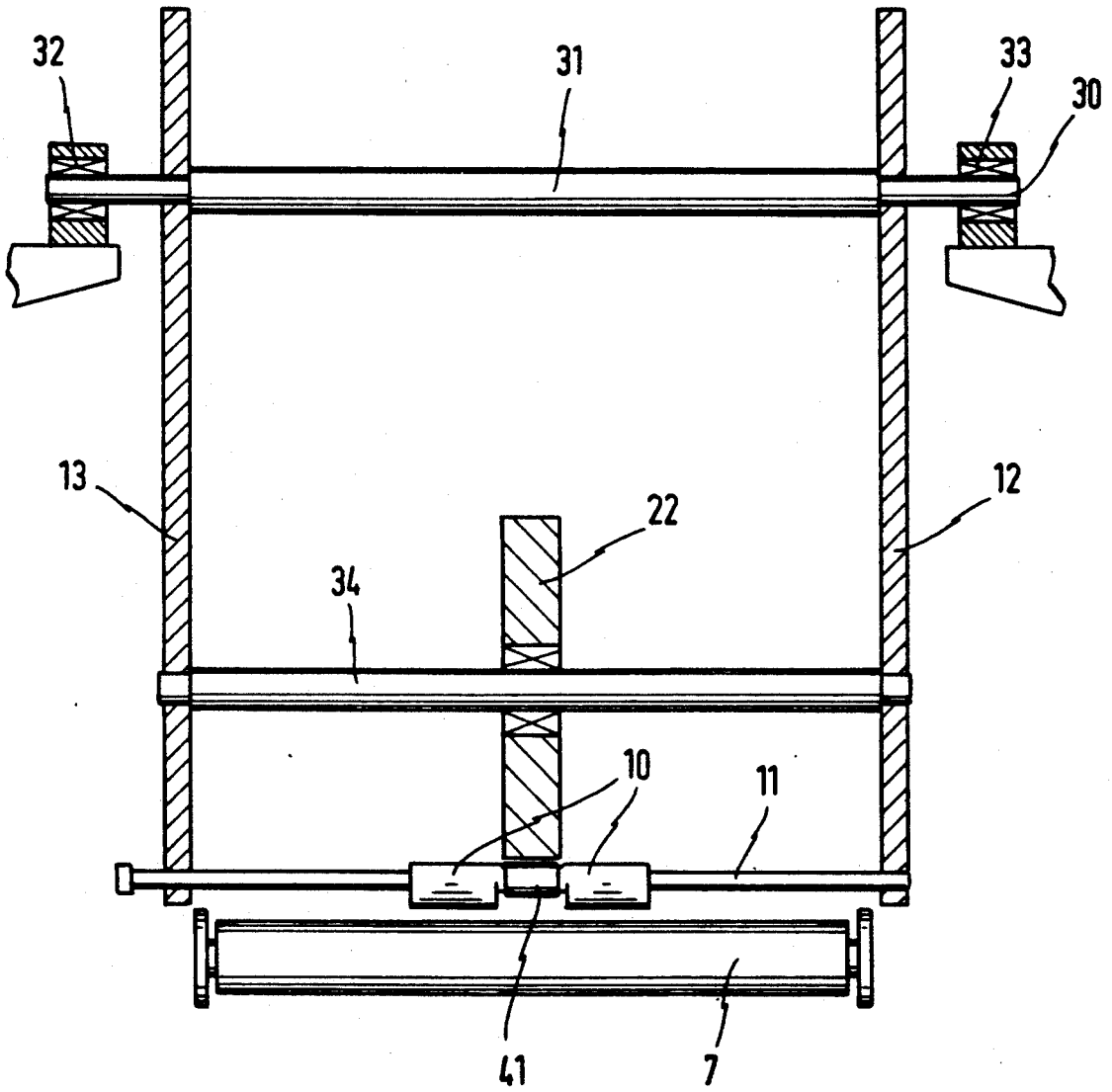
FIG. 2 is a detail along the line 2—2 in FIG. 1 shown greatly magnified.

The wedge-shaped parting means 10—as can be seen from FIG. 2—is two-part and keyed to the shaft 11. This wedge-shaped parting means is free to swivel, as indicated by the arrow 40. Between the two-part parting means 10 a small deflector sheave 41 is mounted free to turn on the shaft 11. This deflector sheave serves to guide the inner press belt 20.

Figure 3:
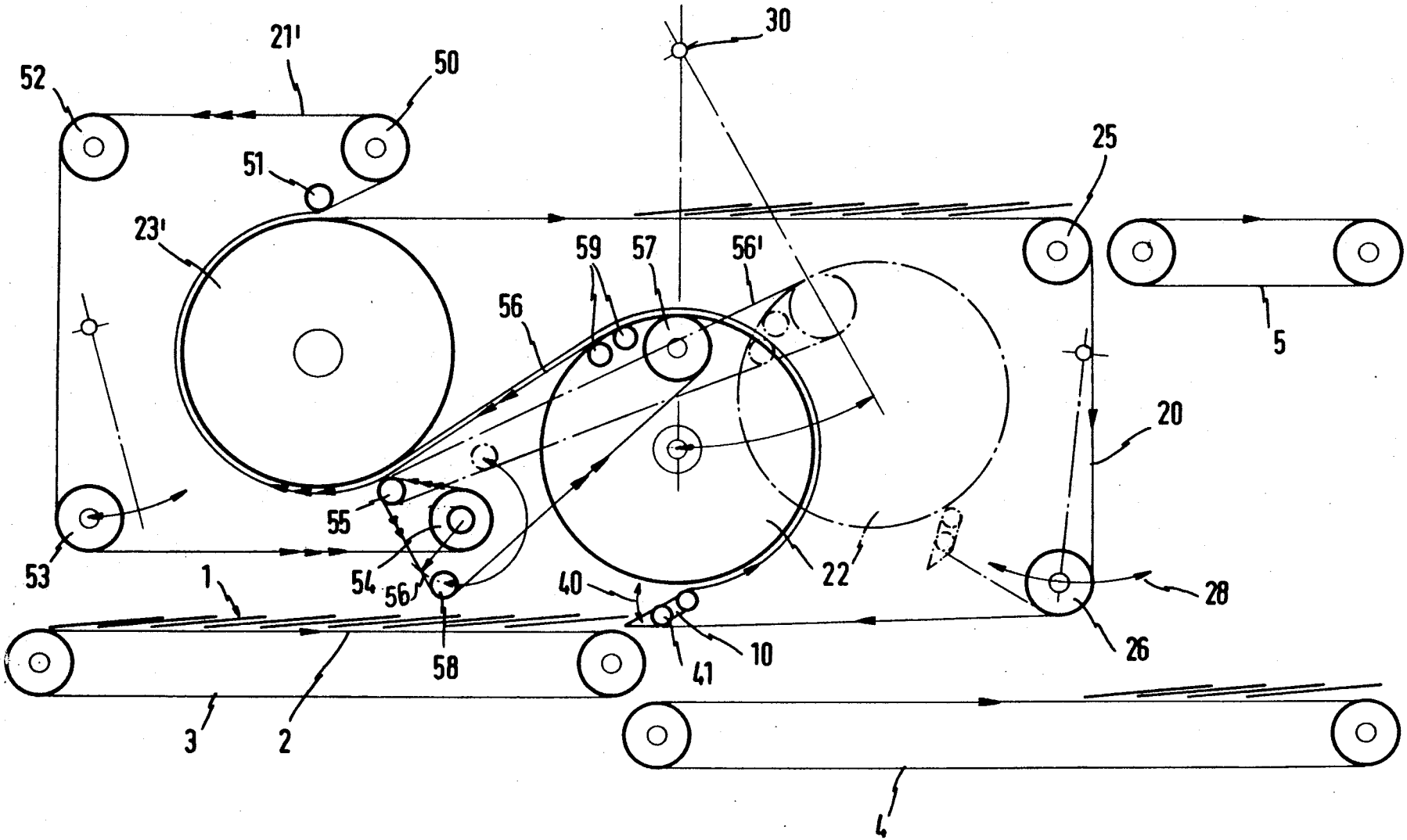
FIG. 3 is a side view of a modified embodiment and FIG. 4 is a detail along the line 4—4 in FIG. 3 shown greatly magnified.
Figure 4:
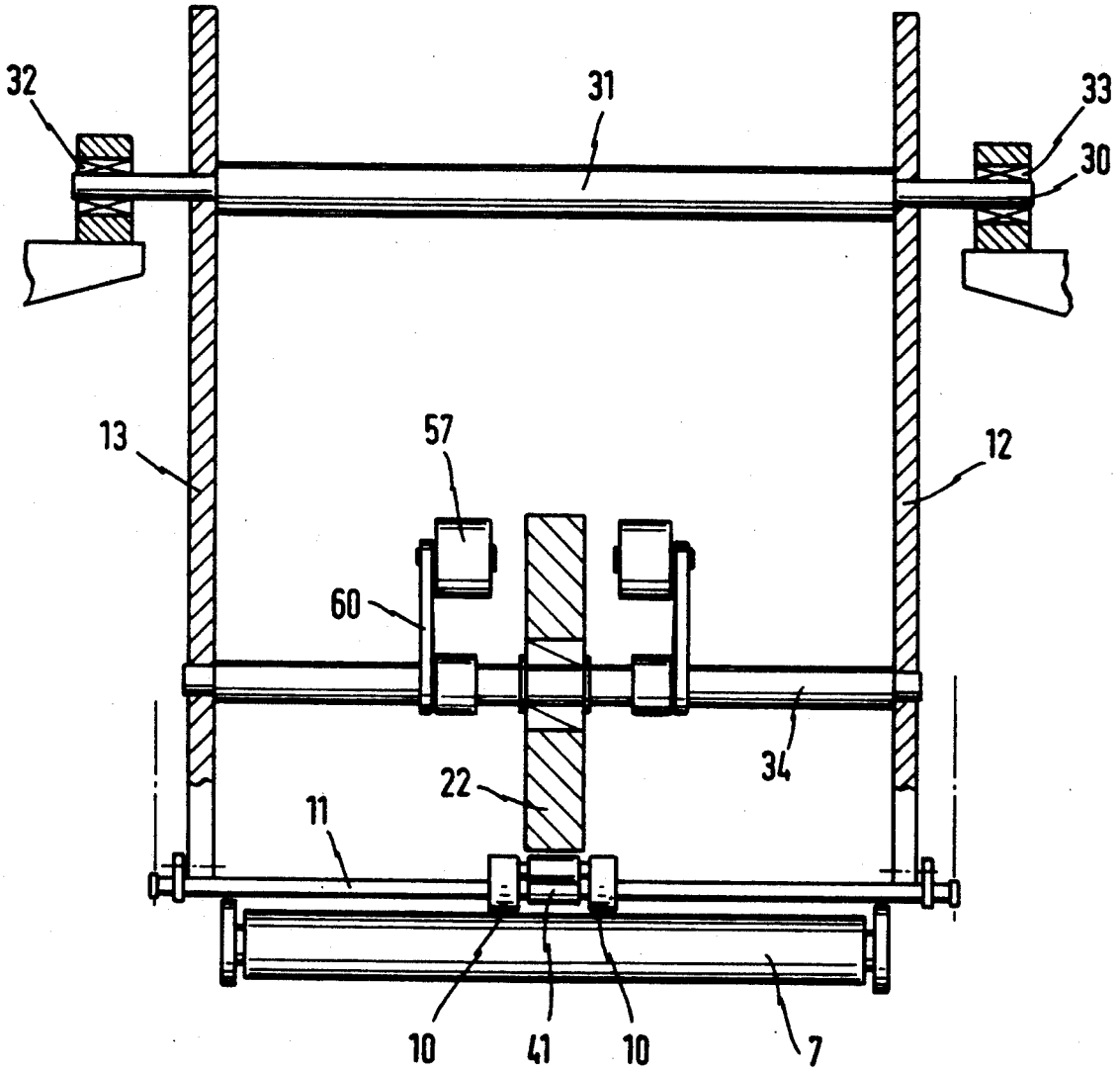

In the embodiment as shown in FIG. 3 and FIG. 4 the feed conveyor 3 and the two discharge conveyors 4 and 5 are arranged in the same position as in the embodiment as shown in FIG. 1 and FIG. 2 respectively. The outer press belt 20 has substantially the same run as the embodiment shown in FIGS. 1 and 2, except that swivelling of the deflector sheave 26 is substantially in the horizontal direction as indicated by the arrow 28'.

However, the aforementioned inner press belt 21' is considerably shorter in the embodiment according to FIGS. 3 and 4 than as shown in the embodiment of FIGS. 1 and 2.

The press belt 21' runs around the deflector sheaves 50, 52, 53, 54 and the small deflector sheaves 55 and 51, it being wrapped around the overhead conveyor 23' by approx. 200 degrees of an arc in-between.

Between the deflector sheave 22 and the overhead conveyor 23' a rider belt 56 is inserted which runs around the deflector sheaves 57, 58 and 55 and is supported by the backup rollers 59. After swivelling the holder rods 12 and 13—in the same way as already described in conjunction with the above embodiment—the rider belt 56 assumes the position 56 as indicated by the dashed line, this being achieved by swivelling of the deflector sheave 58.

As can be seen from FIG. 4 two rider belts are provided on both sides of the deflector sheave 22. The deflector sheave 22 57 is connected by a holder 60 to the shaft 34 of the deflector sheave 22. Accordingly, the second rider belt is held and guided on the other side of the deflector sheave 58, it making the same change in position, of course, as the rider belt 56 due to swivelling of the deflector sheave.

What is claimed is:

1. An apparatus for parting a shingled flow of flat products, particularly of at least two-layer paper products for conveying said products to either of two vertically spaced-apart conveying paths, comprising a rotatable deflector sheave having means for conveying said products to one of said two conveying paths; a wedge-shaped deflector means for insertion into the shingled flow, comprising an interacting pair of press belts for discharging the component of the shingled flow parted by the wedge-shaped deflector means; means for pivoting said deflector sheave and said wedge-shaped deflector means about a point of rotation above said shingled flow, comprising a bracket connected to said deflector sheave and said wedge-shaped deflector means, whereby said wedge-shaped deflector means is insertable into said shingled flow of paper products and retractable at a speed in the conveying direction which exceeds the conveying speed of the shingled flow; wherein the wedge-shaped deflector means is followed in the conveying direction by said deflector sheave having a press belt; further comprising an overhead conveyor following the deflector sheave in the conveying direction; further comprising an endless rider belt inserted between the deflector sheave and the overhead conveyor, and the overhead conveyor further comprises a pair of press bands, wherein the rider belt an the pair of press bands revolve about a common axis when the wedge-shaped deflector means is inserted into the shingled flow.

2. An apparatus for parting a shingled flow of flat products, particularly of at least two-layer paper products for conveying said products to either of two vertically spaced-apart conveying paths, comprising a rotatable deflector sheave having means for conveying said products to one of said two conveying paths; a wedge-shaped deflector means for insertion into the shingled flow; means for pivoting said deflector sheave and said wedge-shaped deflector means as a unit about a point of rotation above said shingled flow whereby said wedge-shaped deflector means is insertable into said shingled flow of paper products and said unit is retractable at a speed in the conveying direction which exceeds the conveying speed of the shingled flow, said means for pivoting said wedge-shaped deflector means about a point of rotation located above the shingled flow further comprising movable holding means connected to said deflector sheave and said wedge-shaped deflector means; said deflector sheave means for conveying said products to one of said two conveying paths further comprises an interacting pair of press belts for discharging the component of the shingled flow parted by the wedge-shaped deflector, said wedge-shaped deflector means being followed in the conveying direction by said deflector sheave having a press belt; and further comprising a further conveyor following the deflector sheave in the conveying direction, with an endless rider belt inserted between the deflector sheave and further conveyor, and the further conveyor comprising a pair of press bands which revolve about a common axis with the rider belt when the wedge-shaped deflector means is inserted into the shingled flow.

* * * * *

UNITED STATES PATENT AND TRADEMARK OFFICE

CERTIFICATE OF CORRECTION

PATENT NO. : 5,143,369

DATED : September 1, 1992

INVENTOR(S) : Ronald Meisel, Michael Hast

It is certified that error appears in the above-identified patent and that said Letters Patent is hereby corrected as shown below:

On the title page: Item [56]

In the "References Cited," the reference "Sudad et al" should read -- Suda et al --.

In column 4, line 22, "22 57" should be -- 57 --; in column 4, line 25, "58" should be -- 22 --; in column 4, line 27, "deflector sheave" should be -- deflector sheave 58 --; in column 4, line 54, "an" should be -- and --.

Signed and Sealed this

Fourteenth Day of September, 1993

Bruce Lehman

*Attest:*

BRUCE LEHMAN

*Attesting Officer*

*Commissioner of Patents and Trademarks*